US006976610B2

(12) United States Patent
Rigel

(10) Patent No.: US 6,976,610 B2
(45) Date of Patent: Dec. 20, 2005

(54) RETRACTABLE SPOUT ASSEMBLY FOR BOTTLES

(76) Inventor: Doron Rigel, Moshav Aviel, D.N. Menashe, 37835 (IL)

( * ) Notice: Subject to any disclaimer, the term of this patent is extended or adjusted under 35 U.S.C. 154(b) by 202 days.

(21) Appl. No.: 10/602,648

(22) Filed: Jun. 25, 2003

(65) Prior Publication Data

US 2005/0006418 A1 Jan. 13, 2005

(51) Int. Cl.[7] ..... B67D 3/00

(52) U.S. Cl. ..... 222/523; 222/569; 222/74; 141/308

(58) Field of Search ..... 222/74, 109, 481.5, 222/520, 523, 569, 571; 141/291, 292, 308, 141/352, 353

(56) References Cited

U.S. PATENT DOCUMENTS 3,217,935 A * 11/1965 Burt ..... 222/109
3,606,096 A * 9/1971 Campbell ..... 222/479
4,917,268 A * 4/1990 Campbell et al. ..... 222/109
5,107,909 A * 4/1992 Donovan ..... 141/296
6,026,994 A * 2/2000 Rigel ..... 222/538
6,478,058 B1 * 11/2002 Pears ..... 141/353

* cited by examiner

*Primary Examiner*—Michael Mar
*Assistant Examiner*—Melvin A. Cartagena

(57) ABSTRACT

A retractable spout assembly for application to the neck of a bottle includes: a sleeve-like housing fixedly receivable within the bottle neck; a spout movable within the housing from a retracted position, when the housing is fixed within the bottle neck and the bottle neck closed by the cap, to an extended position projecting outwardly of the housing and the bottle neck for pouring out contents of the bottle; and an air-return passageway for returning air into the bottle when contents therefrom are being poured out through the spout. The air-return passageway is fixed with respect to the housing such that it does not change its position during the extension and retraction of the spout. The housing is formed with a plurality of holes adjacent its inner end to enable complete emptying of the bottle. The outer surface of the spout is tapered, and the outer end of the housing is formed with an outwardly-extending annular flange configured to define an annular channel for catching drippings of the spout, and for returning the drippings into the bottle when the spout is moved to its retracted position.

17 Claims, 6 Drawing Sheets

RETRACTABLE SPOUT ASSEMBLY FOR BOTTLES

FIELD AND BACKGROUND OF THE INVENTION

The present invention relates to retractable spout assemblies for bottles. The invention is particularly useful with respect to the retractable spout assembly described in my prior U.S. Pat. No. 6,026,994, and is therefore described below with respect to that spout assembly.

My prior U.S. Pat. No. 6,026,994 describes a retractable spout assembly for application to the neck of a bottle to be closed by a cap. The assembly includes a sleeve-like housing fixedly receivable within the bottle neck, and a spout movable within the housing from a retracted position, when the housing is fixed within the bottle neck and the bottle neck closed by the cap, to an extended position projecting outwardly of the housing and the bottle neck for pouring out contents of the bottle. To make the spout automatically extendible upon removing the cap, the assembly further includes a spring biasing the spout to its extended position. Such a spring could be omitted, whereupon the spout would be manually movable to its extended position upon removal of the cap.

In either case, the retractable spout assembly further includes an air-return passageway for returning air into the bottle when its contents are being poured out through the spout.

Such a retractable spout assembly has been very favorably received by the industry and has in fact won a prestigious industrial prize in its field.

OBJECTS AND BRIEF SUMMARY OF THE PRESENT INVENTION

An object of the present invention is to provide improvements in such a retractable spout assembly imparting a number of advantages as will be described more particularly below.

According to one feature in the improved retractable spout assembly of the present invention, the spout is movable with respect to the air-return passageway such that the air-return passageway does not change its position with respect to the housing during the extension and retraction of the spout. In one described preferred embodiment of this feature, the air-return passageway includes a tube fixed at its inner end with respect to the housing and having an outer end telescopingly movable within a passageway in the spout. The tube thus also guides the movements of the spout to its retracted and extended positions. In another described preferred embodiment, the air-return passageway is formed in the housing and extends longitudinally through a wall of the housing.

As will be described more particularly below, this improved feature not only makes the retractable spout assembly more compact in construction and more reliable in operation, but also better enables the assembly to be accommodated by existing bottle-filling machines so that virtually no change is required in such expensive machines when used with caps including the novel retractable spout assembly.

According to another improved feature of the present invention, the outer surface of the outer end of the housing is formed with a plurality of annular ribs axially-spaced from each other and having an outer diameter substantially equal to the inner diameter of the bottle neck, for fixing the housing within the bottle neck; and the housing is formed with a plurality of radially-extending holes between the plurality of annular ribs and the inner end of the housing. As will be described more particularly below, this improved feature better enables substantially the complete contents of a bottle equipped with the retractable spout assembly to be emptied.

According to further improved features of the present invention, at least one of the plurality of annular ribs is of a tapered cross-section at its outer tip in the direction such as to facilitate insertion of the housing within the bottle neck, but to resist removal of the housing from the bottle neck without breaking the respective rib. In addition, the outer end of the housing is formed with an inwardly-extending annular wall engageable by the outer surface of the spout in the extended position of the spout to form a seal therewith. This inwardly-extending annular wall will be ruptured if an attempt is made to forcibly remove the spout from the housing. These features effectively prevent a bottle from being filled, or refilled, with a misrepresented liquid (e.g., a cheaper alcoholic beverage) since removal of the assembly from a bottle would not only be difficult, but would also be made clearly apparent.

According to a further feature in the improved retractable spout assembly of the present invention, the outer surface of the spout is tapered such as to decrease its diameter towards its outer end; and the outer end of the housing is formed with an outwardly-extending annular flange configured to define an annular channel for catching drippings of the spout, and for returning the drippings into the interior of the bottle when the spout is moved to its retracted position.

According to a further improvement, the cap is provided with a connector for retaining the housing, spout, and air passageway within the cap, thereby enabling the latter elements to be applied with the cap to the bottle neck. This feature makes the invention fully compatible with existing bottle-filling and capping machines, since such machines handle the cap, with the retractable spout assembly therein, in the same manner as conventional caps without such assemblies are handled.

Further features and advantages of the invention will be apparent from the description below.

BRIEF DESCRIPTION OF THE DRAWINGS

The invention is herein described, by way of example only, with reference to the accompanying drawings, wherein.

It is to be understood that the foregoing drawings, and the description below, are provided primarily for purposes of facilitating understanding the conceptual aspects of the invention and various possible embodiments thereof, including what is presently considered to be a preferred embodiment. In the interest of clarity and brevity, no attempt is made to provide more details than necessary to enable one skilled in the art, using routine skill and design, to understand and practice the described invention. It is to be further understood that the embodiments described are for purposes of example only, and that the invention is capable of being embodied in other forms and applications than described herein.

DESCRIPTION OF THE PRIOR ART DEVICE OF U.S. Pat. No. 6,026,994

Figure 1:
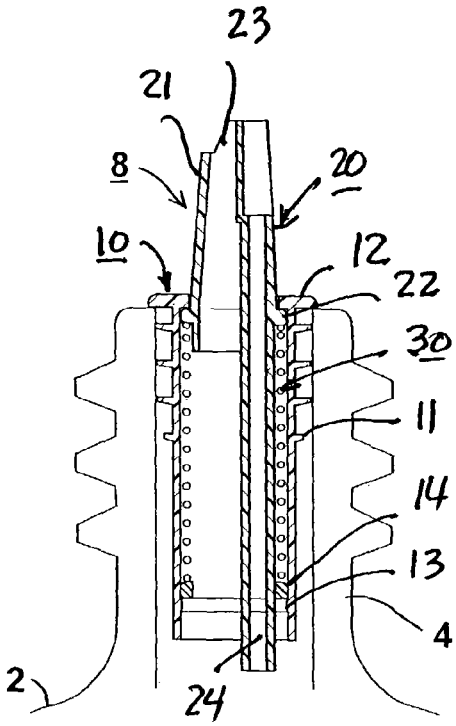
FIG. 1 (PRIOR ART)
FIGS. 1 and 2 are sectional views illustrating the retractable spout assembly described in my above-cited U.S. Pat. No. 6,026,994 in its closed and open positions, respectively.
Figure 2:
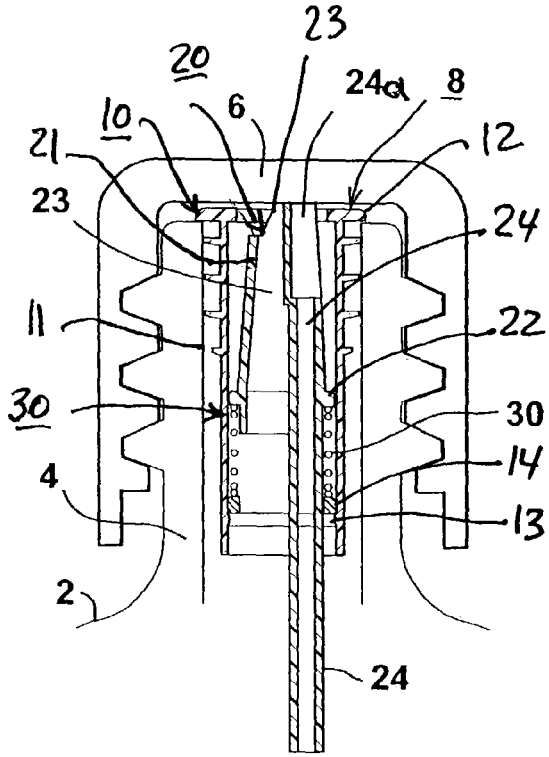
FIG. 2 (PRIOR ART)

With reference first to FIG. 1, there is illustrated the retractable spout assembly of my prior U.S. Pat. No. 6,026,994 applied to a bottle, generally designated 2, formed with a neck 4 closed by a cap 6. The spout assembly, generally designated 8 in FIGS. 1 and 2, is fixedly received within neck 4 of the bottle 2, so that it does not have to be repeatedly applied and removed. Thus, whenever cap 6 is removed, the spout within the assembly 8 automatically moves to an extended position to enable it to be used for pouring out the bottle contents; and whenever the cap is re-applied, it automatically moves the spout to its retracted position.

More particularly the spout assembly 8 includes a sleeve-like housing, generally designated 10, fixedly receivable within the bottle neck 4; a spout, generally designated 20, extending through the housing and movable therein to an extended position projecting outwardly of the bottle neck to facilitate pouring the contents from the bottle, and to a retracted position disposed within the neck when closed by the cap 6; and a coiled spring, generally designated 30, normally urging the spout 20 to its extended position but compressible to permit moving the spout to its retracted position.

Housing 10 is formed at its outer end (with respect to bottle 2) with a plurality of annular ribs 11 axially-spaced from each other and having an outer diameter substantially equal to the inner diameter of the bottle neck 4, for fixing the housing within the neck. Housing 10 is further formed with a flange 12 of larger outer diameter than the ribs 11 to limit against the outer surface of the neck 4 when the housing is fixed within the neck. The opposite end of housing 10 (i.e., the end facing the interior of the bottle) is formed on its inner surface with an annular rib 13 adapted to receive a snap-ring 14, which ring serves as one end of an abutment for the coil spring 30. The opposite end (outer end with respect to the interior of the bottle 2) of the coil spring 30 abuts against the spout 20, as described below.

Spout 20 is thus movable to an extended position by spring 30 when cap 6 is removed, or to a retracted position when the cap is applied. The outer end of spout 20 is formed with an outer conical or tapered surface 21 decreasing in diameter in the outward direction, to facilitate its movement within the cylindrical housing 10. The inner end of spout 20 is formed with an outer annular rib 22 which serves as an abutment for the outer end of spring 30. The latter spring normally urges rib 22 of spout 20 against the inner surface of flange 12 of the housing 10 to define the extended position of the spout.

Spout 20 is formed with two passageways, namely: a first passageway 23 for the liquid (or other pourable material) to be poured from the bottle 2; and an air passageway 24 for returning air into the interior of the bottle when its contents are being poured. The air passageway 24 is in the form of a tube which includes a rectangular recess **24*a* formed in the outer surface of the outer end of spout 20 and extending axially a short distance thereof. Tube 24 communicates with recess 24*a* and is of a length to project inwardly of the inner end of housing 10**.

The outer end 25 of spout 20 is cut at a bias (e.g., about 50 degrees) on the side thereof occupied by the contents-flow passageway 23, i.e., opposite to the air-return passageway 24, to facilitate pouring out the contents from the bottle while permitting air to pass into the bottle.

In assembling the foregoing elements, the spout 20 is passed through the interior of the housing 10 until rib 22 of the spout abuts the inner surface of flange 12 of the housing. Coil spring 30 is inserted into the housing such that the upper end of the spring abuts annular rib 22 of the spout 20. Finally, snap-ring 14 is inserted into the housing 10 to engage the opposite end of spring 30. It will thus be seen that spring 30 normally urges the spout 20 to the outermost or extended position of the spout.

The spout assembly 8 is then inserted into the bottle neck 4 with the ribs 11 of the housing 10 firmly engaging the interior of the bottle neck to fix the housing therein, and with the inner surface of housing flange 12 engaging the outer tip of the bottle neck.

It will thus be seen that each time cap 6 is removed, the spout 20 is automatically moved to its extended position by spring 30 to enable the spout to be used for pouring out contents of the bottle via passageway 23 of the spout, while air is returned into the interior of the bottle via passageway 24. When cap 6 is re-applied to the bottle neck 4, spout 20 is automatically moved by the cap to the retracted position, which is permitted by the compression of spring 30. Accordingly, each time the cap is to be applied to a bottle containing the spout assembly, it is not necessary to remove the spout assembly as in conventional spout constructions.

Further details of the construction of the retractable spout assembly illustrated in FIG. 1, and the manner of using such an assembly, are set forth in the above-cited U.S. Pat. No. 6,026,994, the entire contents of which are incorporated herein by reference.

DESCRIPTION OF PREFERRED EMBODIMENTS OF THE PRESENT INVENTION

As indicated earlier, the present invention provides a number of improvements in the construction of the retractable spout assembly illustrating in FIG. 1 and more particularly described in U.S. Pat. No. 6,026,994. Two embodiments of an improved retractable spout assembly constructed in accordance with the present invention are described below, as illustrated in FIGS. 3–11 and in FIGS. 12–14, respectively. To facilitate understanding, those elements in the embodiment of FIGS. 3–11 and 12–14, which generally correspond to the elements described above with respect to the previously patented construction of FIGS. 1 and 2, are identified by the same reference numerals but increased by "100" in the embodiment of FIGS. 3–11 and by "200" in the embodiment of FIGS. 12–14.

The Embodiment of FIGS. 3–11

The retractable spout assembly illustrated in FIGS. 3–11, and therein generally designated 108, for application to the neck of a bottle (not shown) to receive a cap 106, includes the same basic elements as the previously patented construction illustrated in FIG. 1. Thus, the assembly illustrated in FIGS. 3–11 also includes a sleeve-like housing, generally designated 110 fixedly receivable within the bottle neck; a spout, generally designated 120, from a retracted position (FIG. 4) when the housing is fixed within the bottle and the bottle neck closed by the cap, to an extended position (FIG. 5) projecting outwardly of the bottle neck and of the housing for pouring out contents of the bottle; and a coiled spring, generally designated 130, normally urging the spout 120 to its extended position, but compressible to permit moving the spout to its retracted position.

Figure 3:
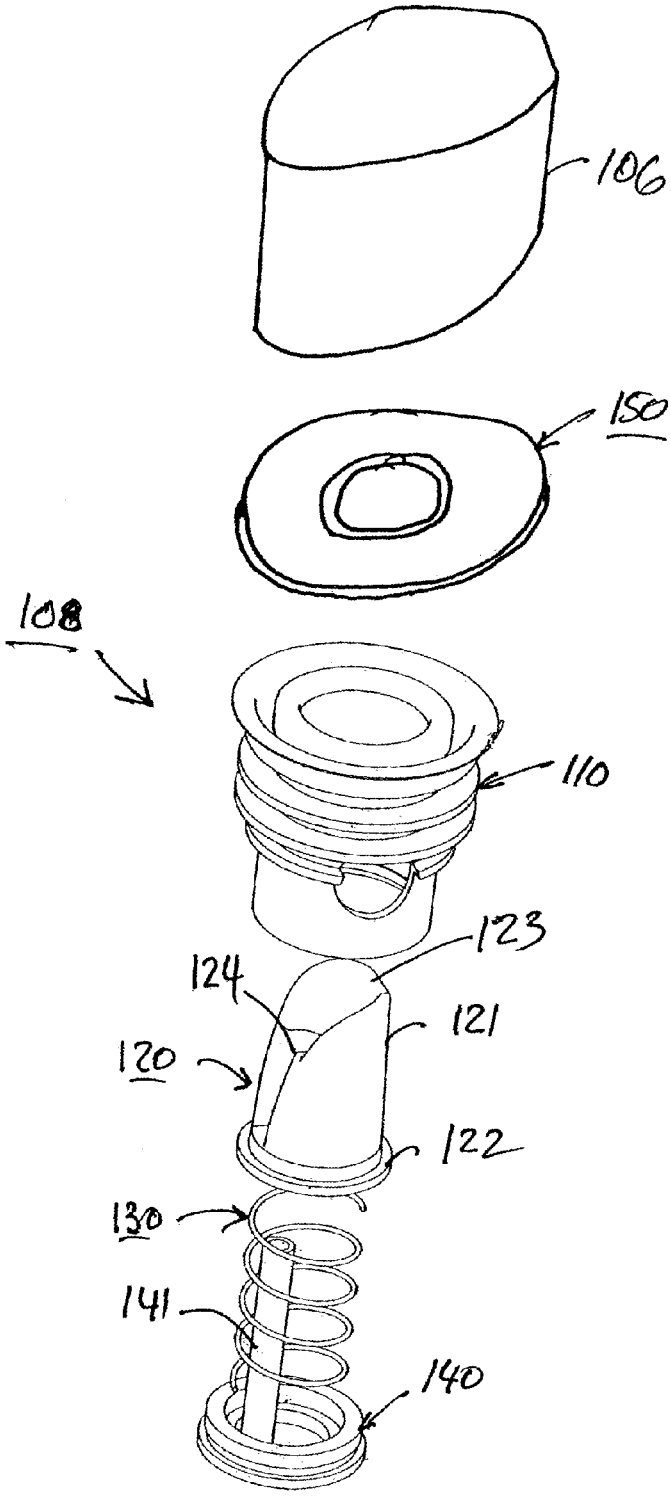
FIG. 3 is an exploded view illustrating one form of retractable spout assembly constructed in accordance with the present invention.

As shown particularly in FIG. 3, spout 120 is also formed with an outer conical or tapered surface 121, decreasing in diameter in the outward direction, to facilitate its movement within housing 110, and with an outer annular rib 122 at its inner end. However, in this case rib 122 does not serve as an abutment for spring 130. Rather, the improved retractable spout assembly is provided with a separate ring, generally designated 140 in FIG. 3, which performs this function.

As in the previously patented assembly of FIGS. 1 and 2, spout 120 in the improved assembly illustrated in FIGS. 3–11 also includes a passageway 123 for the liquid (or other pourable material) to be poured from the bottle. However, whereas in the assembly of FIGS. 1 and 2, the spout is formed with the air-return passageway 24 so that it moves with the spout, spout 120 in the improved assembly is not formed with the air-return passageway, but rather is formed with a longitudinally-extending recess 124, of semi-circular cross-section, for accommodating an air-return tube 141 fixed to ring 140 which serves as the air-return passageway.

Figure 9:
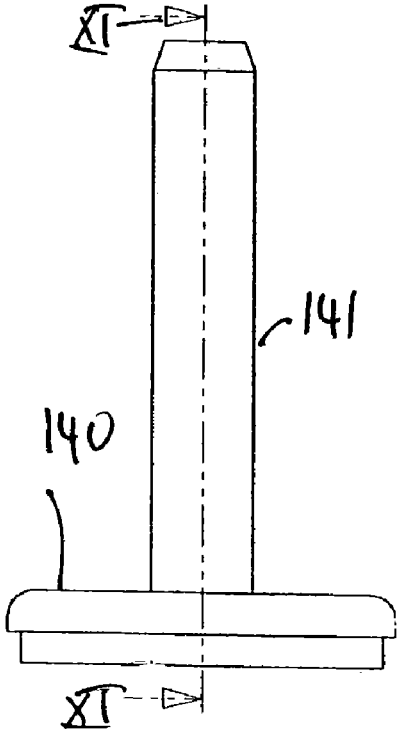
FIGS. 9 and 10 are side and top views, respectfully, illustrating a ring mounting the inner end of the air-return passageway in the retractable spout assembly of FIGS. 3–7.
Figure 11:
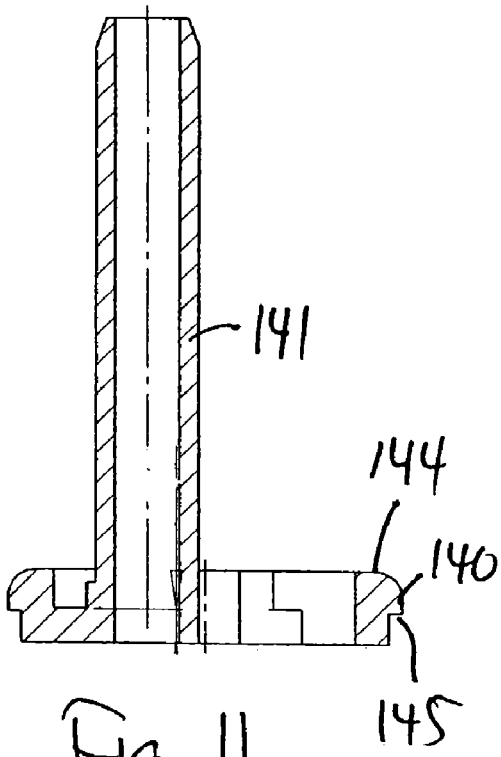
FIG. 11 is a section along line XI—XI of FIG. 9.
Figure 10:
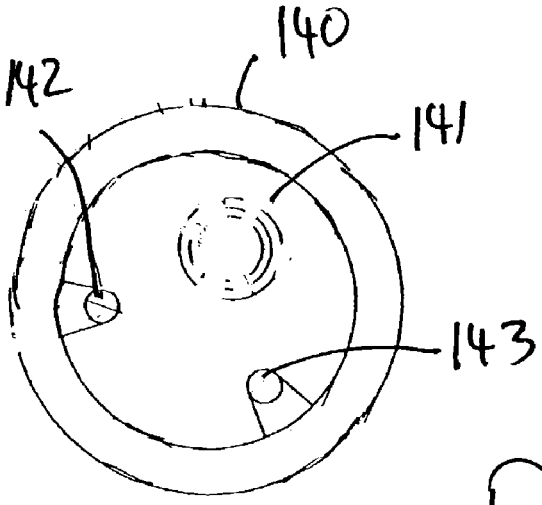

As shown more particularly in FIGS. 9–11, air-return tube 141 is integrally formed with ring 140 and extends parallel, but eccentrically, to the longitudinal axis of the ring. Tube 141 is straddled on its opposite sides by a pair of radially-extending tabs 142, 143, also integrally formed with ring 140 and equally spaced from each other and from tube 141, to serve as a seat for the coiled spring 130.

Figure 8:
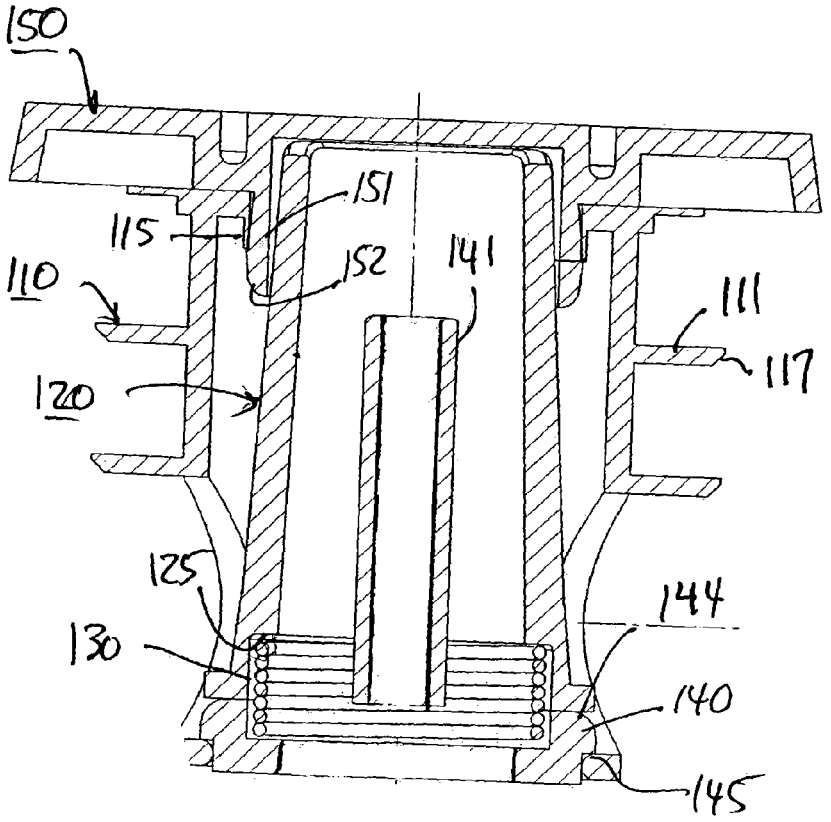
FIG. 8 is a sectional view along line VIII—VIII of FIG. 7.

As shown particularly in FIG. 8, ring 140 is fixedly received within the lower end of housing 110, with its tube 141 received within the semi-cylindrical recess 124 (FIG. 6) of spout 120. Spring 130 is interposed between the inner surface of ring 140 and an annular shoulder 125 formed in the inner surface at the lower end of the spout, such as to urge the spout outwardly to its extended position. When the spout moves towards its extended position, tube 141, which serves as the air-return passageway, does not move with the spout; but since it is received within recess 124 of the spout which is of complementary configuration as the outer surface of tube 141, the tube guides the movements of the spout between its extended end retracted positions.

In the illustrated example, tube 141 is of a length such that its outer end is recessed with respect to the outer end of housing 110. The inner end of tube 140 is substantially aligned with the inner end of spout 120, thereby better assuring the unrestricted inflow of air into the bottle while contents are poured therefrom via the spout.

As shown particularly in FIGS. 8 and 11, the inner surface of ring 140 is rounded or tapered, as shown at 144, to facilitate its insertion into the inner end of housing 120. The opposite surface of ring 140 is formed with a right-angle annular shoulder 145, to firmly retain the ring within the housing and to prevent its forcible removal therefrom.

In the improved construction of FIGS. 3–11, the assembly further includes a connector disc, generally designated 150. Disc 150 actually serves three functions: Its primary function is to serves as a connector for connecting the retractable spout assembly to cap 106 and for retaining the assembly within the cap, to thereby enable the cap, with the retractable spout assembly, to be handled by existing bottle-filling and capping machines. Disc 150 also serves as a liner for the cap. In addition, disc 150 also serves a sealing function for sealing the spout 120 when in its retracted position, as illustrated in FIG. 8.

Connector disc 150 is fixedly received within the cap 106. It includes an annular wall or stem 151 rounded at its tip 152 so as to be receivable between a thin, inwardly-extending annular wall 115 of housing 110 and the spout 120. Thus, when cap 106 (FIG. 3) is applied to the outer end of the bottle neck having the retractable spout assembly fixed therein, annular stem 151 of sealing disc 150 effectively seals the spout in its retracted position. On the other hand annular wall 115 of the housing 110, engageable with the outer tapered surface of the spout, seals the spout when the cap is removed and the spout is in its extended position.

Figure 4:
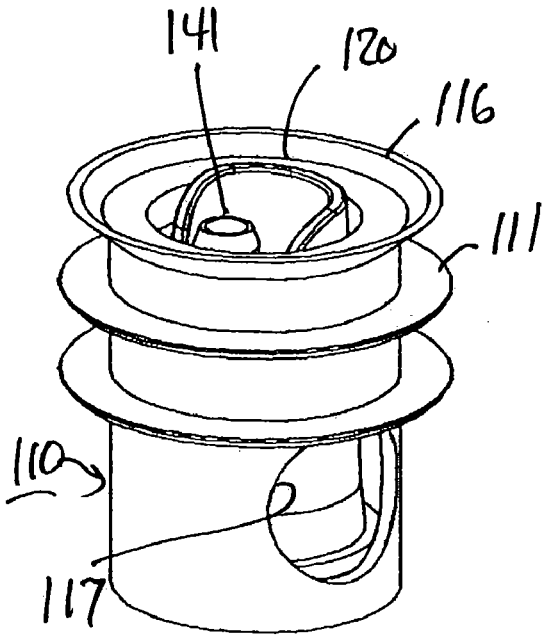
FIGS. 4 and 5 are three-dimensional views illustrating the retractable spout assembly of FIG. 3 in its retracted and extended positions, respectively.
Figure 5:
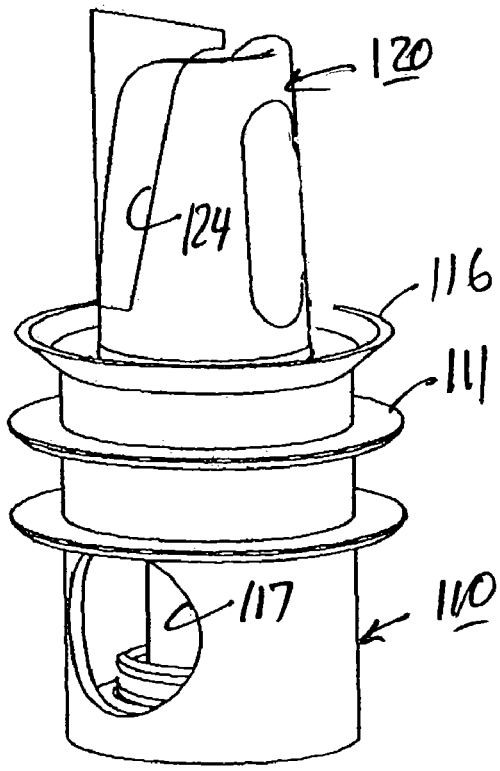
Figure 6:
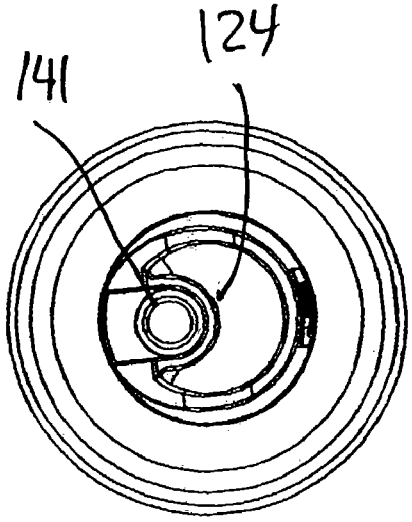
FIG. 6 is a top plan view of the retractable spout assembly of FIGS. 3–5.
Figure 7:
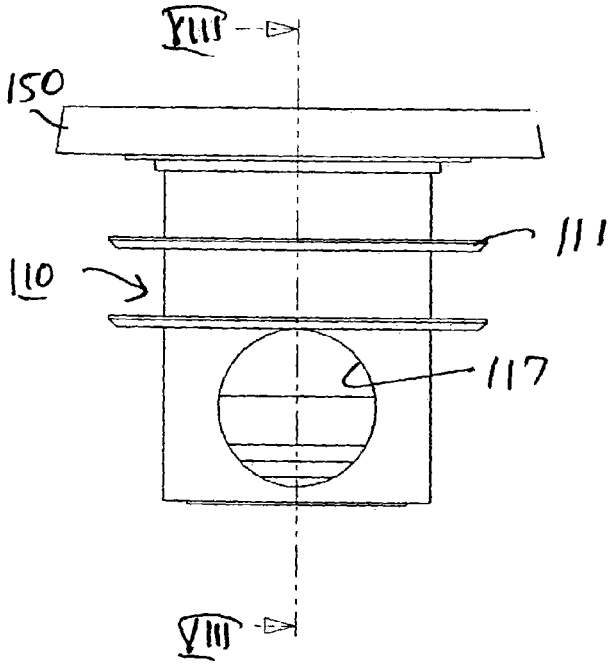
FIG. 7 is a side view of the retractable spout assembly of FIGS. 3–6.

As shown particularly in FIGS. 4 and 5, the outer end of housing 110 is further formed with a thin annular flange 116 normally angled with respect to the outer face of housing 110, so as to define therewith, and particularly with the inwardly-extending thin annular wall 115, an annular channel for catching drippings from the spout. Because of the tapered configuration of the outer surface of the spout, such drippings flow back into the bottle along the outer surface of the spout when the spout is moved, either manually or by the application of the cap 106, towards its retracted position.

Housing 110 is further formed with one or more radially-extending openings 117 adjacent its inner end, i.e., between its inner end and its annular ribs 111. Preferably, there is at least one of such radial openings 117 on each of its opposite sides. Such openings better enable the complete contents of the bottle to be emptied.

In addition, the outer tips of the annular ribs 111 formed in housing 110 are preferably of a tapered construction. Thus, as shown in FIG. 8, the outer tips 117 of the annular ribs 111 are tapered in the direction to facilitate their insertion into the bottle neck and to resist the removal of the housing from the bottle neck once inserted, without breaking the ribs. This feature is provided to prevent removing the retractable spout assembly from a bottle in order to refill it, or to add to it, another liquid, namely one not that represented on the label viewable to a customer.

Annular wall 115, in addition to its functions for sealing the spout and catching the drippings from the spout, also effectively prevents removal of the spout 120 from the assembly. Thus an attempt to forcibly remove the spout from housing 110 will break depending wall 115 thereby evidencing what has been done. This feature also prevents any attempt to add or refill the bottle with a liquid other than that represented on its label.

The retractable spout assembly illustrated in FIGS. 3–11 may thus be used in substantially the same manner as the prior art assembly illustrated in FIGS. 1 and 2, to provide substantially all the advantages of that assembly. In addition, the improved retractable spout assembly illustrated in FIGS. 3–11 provides the following additional advantages:

A particularly important advantage of the illustrated retractable spout assembly is that it is fully compatible with existing bottling and capping machines without any changes in such machines. Thus, by providing the cap 106 with the connector disc 150, the retractable spout assembly may be applied to, and retained within, the cap and handled in the same way as caps are handled in existing bottling and capping machines.

In addition, the air-return passageway arrangement, including ring 140 and its air-return tube 141 movable within the semi-cylindrical recess 124 of spout 120, makes the assembly more compact, and more compatible with existing bottle-filling and capping machines. In addition, it more reliably guides the movement of spout 121 to its retracted and extended positions.

The modification in the construction of the housing 110 to include its inwardly-extending annular wall 115 and its outwardly-extending flange 116, also assure a better seal with respect to the spout 120, both in its retracted position and in its extended position. This construction also provides the annular channel defined by flange 116 and wall 115 which effectively catches drippings from the spout and returns them to the interior of the bottle when the spout is moved toward its retracted position.

A further important function of the inwardly-extending annular wall 115 is that it renders readily apparent any attempt to remove the spout 120 in order to refill the bottle with another liquid, since the forcible removal of the spout will rupture this wall.

Further, the provision of the radial openings 117 in the housing 110 permits more complete emptying of the bottle. The tapered tip construction of the annular ribs 111 of the housing 110 not only facilitates the insertion of the retractable spout assembly into a bottle neck, but also makes difficult, or impossible, the removal of the assembly, once inserted, and thereby further prevents or discourages refilling or adding to a bottle a liquid other than what is represented to the customer.

Figure 12:
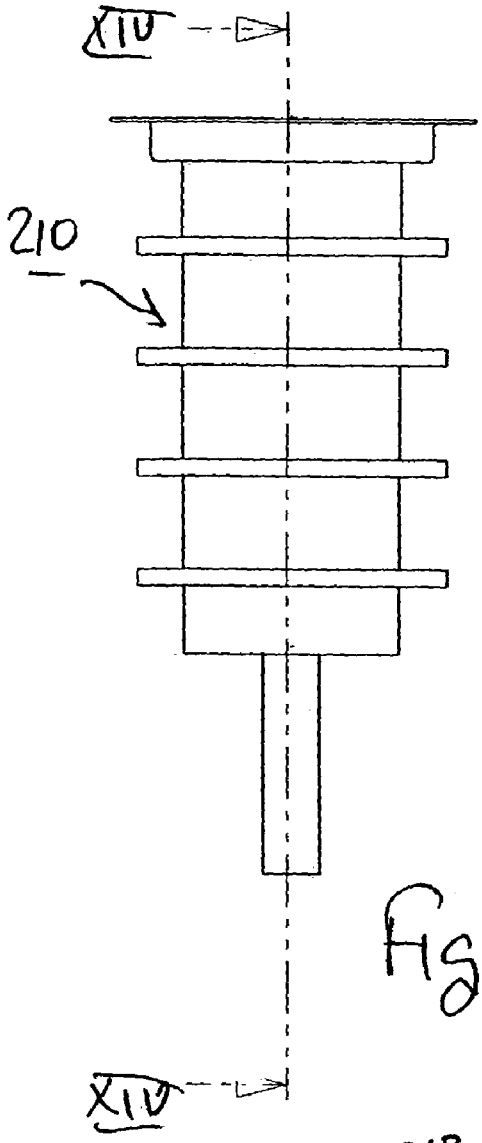
FIGS. 12 and 13 are side and top views, respectfully, illustrating another construction of retractable spout assembly in accordance with the present invention.
Figure 14:
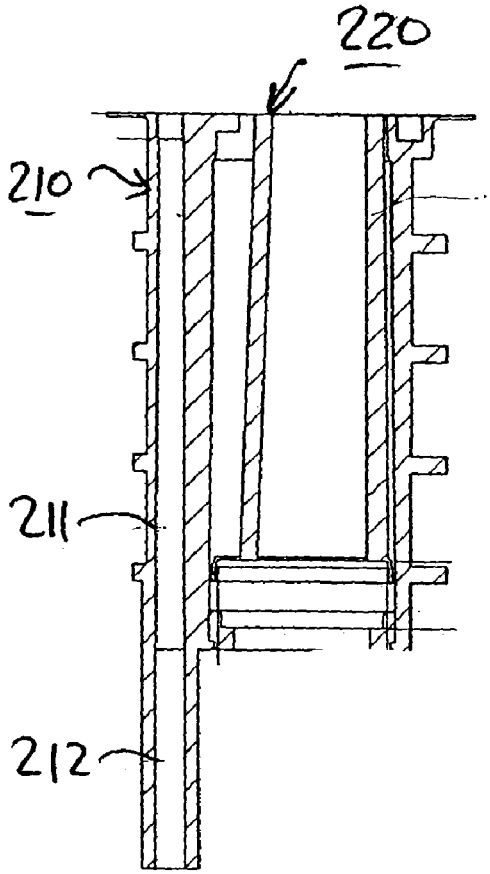
FIG. 14 is a section along line XIV—XIV of FIG. 12.
Figure 13:
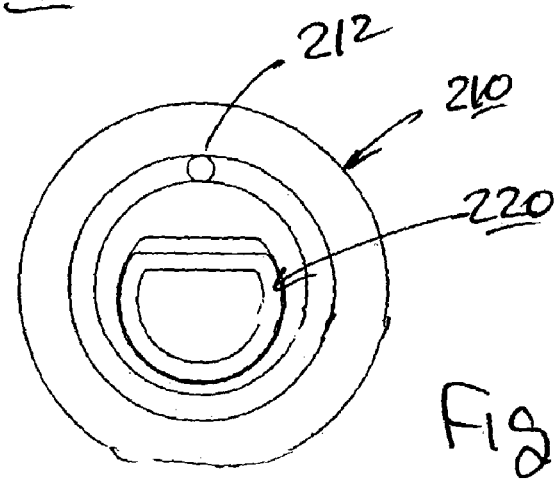

The Embodiment of FIGS. 12–14

The embodiment illustrated in FIGS. 12–14 is basically the same as described above with respect to FIGS. 1 and 2, except that the housing, therein generally designated 210, is integrally formed with the air-return passageway for returning air into the interior of the bottle as contents of the bottle are poured out through the spout.

Thus, as shown in FIGS. 12–14, the air-return passageway is constituted of a passageway 211 extending longitudinally through the housing 210 and communicating with an extension tube 212 at the inner end of the passageway. In this construction therefore, the air-return passageway does not change its position during the retraction or extension of the spout, and thereby makes the assembly more compatible with existing bottle-filling and capping machines.

The retractable spout assembly illustrated in FIGS. 12–14 includes the spout assembly 220 described above in FIGS. 1 and 2, but could be constructed to include one or more of the features described above with respect to FIGS. 3–11 to provide the advantages of such features as also described above.

While the invention has been described with respect to two preferred embodiments, it will be appreciated that these are set forth merely for purposes of example, and that many other variations, modifications and other applications of the invention may be made.

What is claimed is:

1. A retractable spout assembly for application to the neck of a bottle to be closed by a cap, comprising:

a sleeve-like housing fixedly receivable within the bottle neck;

a spout movable within said housing from a retracted position, when the housing is fixed within the bottle neck and the bottle neck closed by the cap, to an extended position projecting outwardly of the housing and the bottle neck for pouring out contents of the bottle;

and an air-return passageway, defined by a fixed passageway extending through said housing, for returning air into the bottle as contents therefrom are poured out through said spout;

said spout being movable with respect to said housing and said air-return passageway such that the air-return passageway does not change its position with respect to said housing during the extension and retraction of the spout.

2. The retractable spout assembly according to claim 1, wherein said air-return passageway includes a tube fixed at its inner end with respect to said housing and having an outer end telescopingly movable within a passageway in said spout.

3. The retractable spout assembly according to claim 2, wherein said latter passageway is a recess formed in the outer surface of said spout and of complementary configuration as said tube such that said tube also guides the spout when moving to its retracted and extended positions.

4. The retractable spout assembly according to claim 2, wherein said tube is fixedly carried by a ring located at the inner end of said housing.

5. The retractable spout assembly according to claim 4, wherein said assembly further includes a coil spring interposed between said ring and said spout and biasing said spout to its extended position.

6. The retractable spout assembly according to claim 5, wherein the inner side of said ring facing said spout is rounded to facilitate insertion of said ring into the inner end of said housing; the outer side of said ring facing away from the spout being formed with a right-angle annular shoulder engageable with the inner surface of the inner side of the housing to prevent movement of said ring outwardly from said housing.

7. The retractable spout assembly according to claim 1, wherein said housing is formed with at least one hole extending radially therethrough adjacent the inner end of the housing to enable emptying substantially the complete contents of the bottle.

8. The retractable spout assembly according to claim 7, wherein the outer surface of the outer end of said housing is formed with a plurality of annular ribs axially-spaced from each other and having an outer diameter substantially equal to the inner diameter of the bottle neck for fixing the housing within the bottle neck; said housing being formed with at least one of said radially-extending holes on each of the two opposite sides of the housing between said plurality of annular ribs and the inner end of the housing.

9. The retractable spout assembly according to claim 8, wherein at least one of said plurality of annular ribs is of a tapered cross-section at its outer tip in the direction such as to facilitate the insertion of the housing into the bottle neck, but to resist the removal of the housing from the bottle neck without breaking the respective rib.

10. The retractable spout assembly according to claim 1, wherein the outer surface of the spout is tapered to decrease its diameter towards its outer end; and wherein the outer end of said housing is formed with an outwardly-extending annular flange configured to define an annular channel for catching drippings of the spout, and for returning said drippings into the interior of the bottle when the spout is moved to its retracted position.

11. The retractable spout assembly according to claim 1, wherein the outer end of said housing is formed with a depending annular wall engageable by the outer surface of the spout in the extended position of the spout to form a seal therewith.

12. The retractable spout assembly according to claim 11, wherein said assembly further comprises a connector disc to be fixed within the cap and having a depending annular stem located to be received between said sleeve and the outer surface of the spout when the cap is applied to the bottle neck to close the bottle and to move the spout to its retracted position.

13. The retractable spout assembly according to claim 12, wherein said housing incudes, at its outer end, a depending annular wall which is deformable when engaged by the outer surface of said annular stem of the connector disc when the cap is applied to close the bottle neck, said deformable annular wall also being engageable by the spout to seal the spout in the extended position of the spout when the cap has been removed.

14. The retractable spout assembly according to claim 1, wherein said air-return passageway is formed in said housing and extends longitudinally through a wall of said housing.

15. A retractable spout assembly for application to the neck of a bottle, comprising:

a sleeve-like housing fixedly receivable within the bottle neck;

a spout movable within said housing from a retracted position, when the housing is fixed within the bottle neck, to an extended position projecting outwardly of the housing and the bottle neck for pouring out contents of the bottle;

an air-return passageway for returning air into the bottle when contents therefrom are being poured out through said spout;

a cap for closing the bottle neck;

and a connector within said cap for retaining said housing, spout and air passageway within said cap, and thereby enabling the latter elements to be applied with the cap to the bottle neck;

the outer surface of the outer end of said housing being formed with a plurality of annular ribs axially-spaced from each other and having an outer diameter substantially equal to the inner diameter of the bottle neck for fixing the housing within the bottle neck;

said housing being formed with a plurality of radially-extending holes between said plurality of annular ribs and the inner end of the housing to enable emptying substantially the complete contents of the bottle.

16. The retractable spout assembly according to claim 15, wherein said connector is a disc which also serves as an inner liner for the cap, and which is formed with an annular depending stem insertable between said housing and said spout for retaining the housing, spout and air passageway with said cap.

17. A retractable spout assembly for application to the neck of a bottle to be closed by a cap, comprising:

a sleeve-like housing fixedly receivable within the bottle neck;

a spout movable within said housing from a retracted position, when the housing is fixed within the bottle neck and the bottle neck closed by the cap, to an extended position projecting outwardly of the housing and the bottle neck for pouring out contents of the bottle;

and an air-return passageway for returning air into the bottle when contents therefrom are being poured out through said spout;

the outer surface of the spout being tapered such as to decrease its diameter towards its outer end; the outer end of said housing being formed with an outwardly-extending annular flange configured to define an annular channel for catching drippings of the spout, and for returning said drippings into the interior of the bottle when the spout is moved to its retracted position;

the outer end of said housing being formed with a depending annular wall engageable by the outer surface of the spout in the extended position of the spout to form a seal therewith; and a connector disc fixed within the cap and having a depending annular stem located to be received between said depending annular wall of the sleeve and the outer surface of the spout, when the cap is applied to the bottle neck to close the bottle and to move the spout to its retracted position.

* * * * *